US007841404B2

(12) United States Patent
Ayasse et al.

(10) Patent No.: US 7,841,404 B2
(45) Date of Patent: Nov. 30, 2010

(54) MODIFIED PROCESS FOR HYDROCARBON RECOVERY USING IN SITU COMBUSTION

(75) Inventors: Conrad Ayasse, Calgary (CA); Xinjie Wu, Calgary (CA); Chris Bloomer, Calgary (CA)

(73) Assignee: Archon Technologies Ltd., Calgary, Alberta (CA)

( * ) Notice: Subject to any disclaimer, the term of this patent is extended or adjusted under 35 U.S.C. 154(b) by 189 days.

(21) Appl. No.: 12/068,881

(22) Filed: Feb. 13, 2008

(65) Prior Publication Data

US 2009/0200024 A1 Aug. 13, 2009

(51) Int. Cl.
*E21B 43/243* (2006.01)

(52) U.S. Cl. ..... 166/257; 166/50; 166/256; 166/260; 166/261; 166/272.7; 166/306; 166/371

(58) Field of Classification Search ..... 166/257, 166/306

See application file for complete search history.

(56) References Cited

U.S. PATENT DOCUMENTS 5,167,280 A * 12/1992 Sanchez et al. ..... 166/267
5,456,315 A * 10/1995 Kisman et al. ..... 166/245
5,626,191 A 5/1997 Greaves et al.
5,626,193 A 5/1997 Nzekwu et al.
6,412,557 B1 * 7/2002 Ayasse et al. ..... 166/261
7,493,952 B2 * 2/2009 Ayasse ..... 166/261
7,581,587 B2 * 9/2009 Pfefferle ..... 166/245
2006/0207762 A1 * 9/2006 Ayasse ..... 166/261
2007/0199706 A1 * 8/2007 Hocking ..... 166/280.1
2007/0256833 A1 * 11/2007 Pfefferle ..... 166/261
2009/0308606 A1 * 12/2009 Ayasse ..... 166/261

FOREIGN PATENT DOCUMENTS

WO WO 2005121504 A1 12/2005
WO WO 2007033462 A1 3/2007

* cited by examiner

*Primary Examiner*—George Suchfield
(74) *Attorney, Agent, or Firm*—Gowling Lafleur Henderson LLP; D. Doak Horne

(57) ABSTRACT

A modified method for in situ recovery of hydrocarbon from an underground hydrocarbon-containing formation. An "L" shaped production well, having a vertical section, and a lower horizontal leg positioned low in the formation, is provided. The horizontal leg connects to the vertical section at a heel portion, and has a toe portion at an opposite end thereof. Oxidizing gas is injected into the formation in or proximate the vertical section. A combustion front sweeps outwardly from the vertical section and laterally within the formation above the horizontal leg, from the heel to the toe, causing hydrocarbons in the formation above the horizontal leg to drain downwardly into the horizontal leg, which are then delivered to surface via production tubing. A non-oxidizing gas is injected into at least the heel portion and preferably additional portions of the horizontal leg via injection tubing contained within the vertical section of the production well.

12 Claims, 8 Drawing Sheets

MODIFIED PROCESS FOR HYDROCARBON RECOVERY USING IN SITU COMBUSTION

FIELD OF THE INVENTION

This invention relates to an modified process for hydrocarbon recovery from an underground reservoir by in situ combustion and employing a horizontal production well.

BACKGROUND OF THE INVENTION

Commonly assigned U.S. Pat. No. 5,626,191 issued May 6, 1997 (hereinafter the '191 patent) discloses an in situ combustion processes for producing hydrocarbon from an underground hydrocarbon reservoir utilizing (i) at least one injection well placed relatively high in an oil reservoir for injecting an oxidizing gas into the hydrocarbon formation, and (ii) a production well for producing liquefied or gasified hydrocarbon from the hydrocarbon reservoir. The production well has a vertical section which is in communication with a horizontal leg extending substantially perpendicularly outwardly from the vertical section and having a "toe" portion and a "heel" portion. The horizontal leg is completed relatively low in the reservoir, and at a "heel" portion thereof is in communication with the vertical section. Air, or other oxidizing gas, such as oxygen-enriched air, is injected through the injection well into the hydrocarbon reservoir, typically via perforations in the upper part of a vertical injection well, located in the vicinity of the "toe" of the horizontal leg of the production well. The horizontal leg of the production well is oriented generally perpendicularly to a generally quasi-vertical combustion front of combusting hydrocarbon which is produced upon ignition of a portion of the hydrocarbon in the reservoir proximate the injection well. Such combustion front is supplied with oxidizing gas via the injection well. The "toe" of the horizontal leg portion is positioned in the path of the advancing combustion front. The resulting combustion front propagates from the "toe" of the horizontal leg along the horizontal leg in the direction of and towards the "heel" portion. During this process heated hydrocarbon in the reservoir in advance of the moving combustion front becomes liquefied or gasified and flows into the horizontal leg, and from such leg thereafter removed to the surface via the vertical section of the production well. This process of U.S. Pat. No. 5,626,191 is called "THAI™", an acronym for "toe-to-heel air injection", and a registered trademark of Archon Technologies Ltd., a subsidiary of Petrobank Energy and Resources Ltd, Calgary, Alberta, Canada.

U.S. Pat. No. 6,412,557, also commonly assigned, discloses a similar but modified process having the added step of placing a hydrocarbon upgrading catalyst along, within, or around the horizontal leg to substantially decrease the viscosity of the hydrocarbon and upgrade the quality of the hydrocarbon and increasing the flow of hydrocarbon from the reservoir into the horizontal leg of the production well for subsequent removal to surface. Such modified process is known in the industry by the trademark CAPRI™, likewise a registered trademark of Archon Technologies Ltd.

WO2005121504 (PCT/CA2005/000833) published Dec. 12, 2005, also commonly assigned, teaches a similar process to that of THAI™, further comprising the additional step of providing injection tubing inside the production well within the vertical section and substantially along the length of the horizontal leg to a position proximate the "toe" thereof, for the purpose of injecting a non-oxidizing medium comprising steam, water, or a non-oxidizing gas via said tubing to the "toe" region of said horizontal leg. The injection of such non-oxidizing medium into the "toe" region of the horizontal leg has the effect of displacing any oxidizing gas in such area and thus preventing combustion of upgraded hydrocarbon which has flowed into the horizontal leg, and further increases the ambient pressure in the horizontal leg so as to prevent or reduce further inflow of oxidizing gas from the injection well which is injecting oxidizing gas into the hydrocarbon reservoir.

Disadvantageously, in each of the above prior art methods for recovering liquefied and/or gasified hydrocarbons from a hydrocarbon formation oxidizing gas is needed to be injected proximate the toe of the horizontal leg, and remote from the vertical section of the production well. Such site of injection of oxidizing gas is remote from the vertical section of the production well, the surface of the production well being the location where oxidizing gas is typically generated. The injection and vertical section of the production wells can be separated by one (1) kilometer or more. Thus such prior art methods thus typically require transport of the oxidizing gas to the site of the injection well via piping from the production well, or alternatively require installation of equipment at the injection well site to permit generation of oxidizing gases for subsequent injection. Such requires clear access, via clearcutting, and/or increased space at the injection well site to accommodate additional oxidizing gas delivery and/or generation and compression facilities, thereby increasing the environmental "footprint" and impact of drilling operations on the environment, and also typically results in increased cost.

Thus a need thus exists for a modified process of THAI™ and CAPRI™ wherein such drawbacks are eliminated.

SUMMARY OF THE INVENTION

The method of the present invention is to a modified in situ hyrdrocarbon recovery process that instead of injecting oxidizing gas near the "toe" portion of the horizontal leg injects oxidizing gas in or near the producing vertical section of the producing well (ie at the "heel" portion). The modified process obviates the need for a separate drilling/production pad for oxidizing gas injection, thereby reducing cost and decreasing detrimental environmental impact of in situ recovery methods.

Advantageously, the process of the present invention in a particular third embodiment described below further eliminates the need for a separate oxidizing gas injection well, in that in such refinement the vertical section of the production well also serves as the injection well, thereby reducing well drilling costs and reducing the capital costs.

Specifically, rather than being a "toe-to heel" process, the process of the present invention is a "heel-to-toe" process. The oxidizing gas injection point is modified to be at the "heel" as opposed to the "toe" so that the combustion front moves in the opposite direction from that of the THAI™ process, namely from the direction of the "heel" of the horizontal well towards the "toe".

In the present invention three regions of the reservoir are developed relative to the position of the combustion zone. Near the "heel" and after the passage of the combustion front away from the "heel" lies the burned oil-depleted zone which results after injection of the oxidizing gas and after the combustion front has advanced for a period outwardly and away from the injection well and the "heel" portion of the horizontal leg. Such burned zone is filled substantially with oxidizing gas. Next lies the coke zone, which is essentially the area within the reservoir which the oxidizing gas has been able to then penetrate in the reservoir, and is essentially the area at which the combustion front exists (the combustion which occurs being that of the remaining coke which is the hydrocarbon then remaining after the lighter hydrocarbons within such reservoir and ahead of such combustion front have been liquefied or gasified and have flowed into the horizontal leg and thereafter removed to surface. Lastly, towards the "toe" of the horizontal well lies the region of the reservoir containing hydrocarbons which the combustion front is advancing toward.

At higher oxidant injection rates, reservoir pressure increases and oxidizing gas in the burned zone, containing residual oxygen, can be forced into the horizontal leg of the production well. This is prevented in the process of the present invention by injecting, either for a limited time, or continuously, a medium such as a non-oxidizing gas such as carbon dioxide, and/or steam or water, to increase the pressure within the horizontal leg of the production well.

Accordingly, in one broad aspect of the process of the present invention, to realize the advantage of being able to inject the oxidizing gas proximate or in the vertical section of the production well, a modified process for recovering liquefied or gasified hydrocarbon from an underground hydrocarbon reservoir is disclosed, comprising the steps of:

(a) providing at least one production well having a substantially horizontal leg positioned relatively low in said reservoir, said horizontal leg having at one end thereof a heel portion and at an opposite end thereof a toe portion, said horizontal leg adapted to permit inflow of hydrocarbon into an interior of said horizontal leg, said production well having a substantially vertical section connected to said horizontal leg proximate said heel portion thereof;

(b) providing production tubing inside said production well extending within said vertical section and within at least a portion of said horizontal leg to collect said hydrocarbon which flows into said horizontal leg;

(c) injecting periodically or continuously a medium into the horizontal leg proximate the heel portion thereof, wherein said medium is selected from the group of mediums comprising alone or in combination, a non-oxidizing gas such as carbon dioxide, steam, or water;

(d) supplying an oxidizing gas to said underground reservoir, at least initially, at a location of or proximate said vertical section of said production well;

(e) igniting hydrocarbon within said hydrocarbon reservoir proximate said injection well, so as to cause combustion of a portion of said hydrocarbon in said hydrocarbon reservoir proximate said vertical section and thereby create a combustion front which advances outwardly and away from said injection well in at least a direction along said horizontal leg and towards said toe portion thereof;

(f) causing heated hydrocarbon from said reservoir to flow from upper regions thereof and collect in said horizontal leg; and (g) removing from the production well, via said production tubing, said hydrocarbon which has flowed into said horizontal leg.

Regarding step (g) above, the removal of the hydrocarbon from the production well via the production tubing is typically without pumping, but may require pumping in order to be removed from the horizontal leg if sufficient quantities of inert gases such as gasified hydrocarbon, carbon dioxide or nitrogen do not flow into the horizontal leg and thus the production tubing under significant ambient pressure of the hydrocarbon formation, as may occur during a start-up period. The normal mechanism of producing oil by reducing the mixed-fluid density with gases is called 'gas lift'.

In a first refinement/embodiment of the above process of the present invention, the injection of the oxidizing gas proximate the vertical section of the production well is accomplished via the drilling of a separate injection well proximate the vertical section of the production well so as to permit the oxidizing gas to be injected into the formation via such injection well proximate the production well. In this manner, and advantageously, the same drilling pad can then be used for drilling both the production well and the injection well, thus saving on expense and cost of well drilling.

Additionally, and advantageously, because the injection well is situated proximate the production well which typically has power generation equipment used for production, oxidizing gas can usually and more easily be obtained and immediately injected into the injection well, which would not otherwise be capable of being done were the injection well positioned remote from the vertical section of the production well as in the prior art.

In a second embodiment of the invention, the injection well is a side entry well within the vertical section of the production well, thus again allowing the injection well to be situated proximate the injection well so as to achieve the above benefits, as well as the additional benefit in that the upper portion of the vertical section of the production well can be used when drilling the side entry well, thus further reducing drilling costs.

Specifically, in such second preferred embodiment, the present invention comprises a process for recovering liquefied or gasified hydrocarbon from an underground hydrocarbon formation comprising the steps of:

(a) providing at least one production well having a substantially horizontal leg positioned relatively low in said formation, said horizontal leg having at one end thereof a heel portion and at an opposite end thereof a toe portion situated in the formation slightly lower in elevation than said heel portion, said horizontal leg adapted to permit inflow of liquefied hydrocarbon into an interior of said horizontal leg, said production well having a substantially vertical section connected to said horizontal leg proximate said heel portion thereof;

(b) providing production tubing inside said production well extending downwardly within said vertical section and along said horizontal leg to said toe portion, to collect said hydrocarbon which flows into said horizontal leg;

(c) providing injection tubing in said production well, said injection tubing extending downwardly in said vertical section to said heel portion;

(d) injecting a medium into said production well via said injection tubing wherein said medium is selected from the group of mediums comprising alone or in combination, a non-oxidizing gas, steam, water, or carbon dioxide;

(e) providing an injection well as a side track re-entry from said vertical section of said production well, which injection well extends into the hydrocarbon formation;

(f) supplying an oxidizing gas to a portion of said hydrocarbon formation via said injection well;

(g) igniting said hydrocarbon in said hydrocarbon formation proximate said vertical section so as to cause combustion of a portion of said hydrocarbon in said hydrocarbon formation and thereby create a combustion front which advances outwardly and away from said vertical section in at least a direction along said horizontal leg and towards said toe portion thereof; and (h) removing from the production well, via said production tubing, hydrocarbon which has flowed into said horizontal leg.

In a third preferred embodiment the present invention comprises a method of producing hydrocarbon from a hydrocarbon reservoir whereby the necessity of an injection well for injecting the oxidizing gas is completely eliminated, thus reducing the cost of implementing the in situ process of the present invention.

Specifically, in such third and preferred embodiment of the present invention, the vertical section of the production well is perforated to permit an oxidizing gas (which is provided to such vertical section) to escape into the hydrocarbon formation proximate the vertical section. In such manner, the need to drill a separate injection well is eliminated.

Again, as part of the method of the present invention, a medium in the form of a non-oxidizing gas such as carbon dioxide, steam or water is injected either continuously or intermittently into the production well via injection tubing, which extends to the heel portion of the production well. A series of "packers" located in the production well may be provided to isolate the oxidizing gas supplied to the vertical section of the production well from the heel portion of the horizontal leg of the production well to which the non-oxidizing medium is supplied.

Thus in such third preferred embodiment, the method of the present invention comprises a process for recovering liquefied or gasified hydrocarbon from an underground hydrocarbon reservoir, comprising the steps of:

(a) providing at least one production well having a substantially horizontal leg positioned relatively low in said reservoir, said horizontal leg having at one end thereof a heel portion and at an opposite end thereof a toe portion, said horizontal leg adapted to permit inflow of liquefied hydrocarbon into an interior of said horizontal leg, said production well having a substantially vertical section connected to said horizontal leg proximate said heel portion thereof;

(b) providing production tubing in said production well, extending from a surface of said production well to at least said heel portion of said production well to collect said hydrocarbon which flows into said horizontal leg;

(c) providing injection tubing in said production well, said injection tubing extending downwardly in said vertical section to a position extending into at least said heel portion of said horizontal leg;

(d) injecting a medium into the production well, wherein said medium is selected from the group of mediums comprising alone or in combination, a non-oxidizing gas such as carbon dioxide, steam, or water;

(e) providing perforations in said vertical section of said production well at a position above said heel portion;

(f) supplying an oxidizing gas to said vertical section and thus to a portion of said hydrocarbon reservoir via said perforations in said vertical section;

(g) igniting said hydrocarbon in said hydrocarbon reservoir proximate said vertical section so as to cause combustion of a portion of said hydrocarbon in said hydrocarbon reservoir and thereby create a combustion front which advances outwardly and away from said vertical section in at least a direction along said horizontal leg and towards said toe portion thereof; and (h) causing heated hydrocarbon from said reservoir to flow from upper regions thereof and collect in said horizontal leg; and (i) removing from the production well, via said production tubing, said hydrocarbon which has flowed into said horizontal leg.

Advantageously, the third embodiment of the present invention also eliminates the need as in the prior art to "close off" (using a cement plug or the like) the horizontal leg of each production well when a series of production wells are situated end to end and when the vertical section of a first production well is subsequently converted to an injection well (see. U.S. Pat. No. '191, col 6, lines 47-col 7, line 9 and FIGS. 14D-F thereof). The in situ method of the present invention, in particular the third embodiment, is a method of further reducing the cost of in situ recovery by reducing the number of steps, including not only eliminating the need to drill injection wells but also eliminating the necessity of "closing off" other wells as is necessary in the in situ methods of the prior art, as exemplified in U.S. Pat. No. '191 above.

BRIEF DESCRIPTION OF THE DRAWINGS

In the accompanying drawings, which illustrate a number of exemplary embodiments of the invention.

DESCRIPTION OF THE PREFERRED EMBODIMENT

Figure 1A:
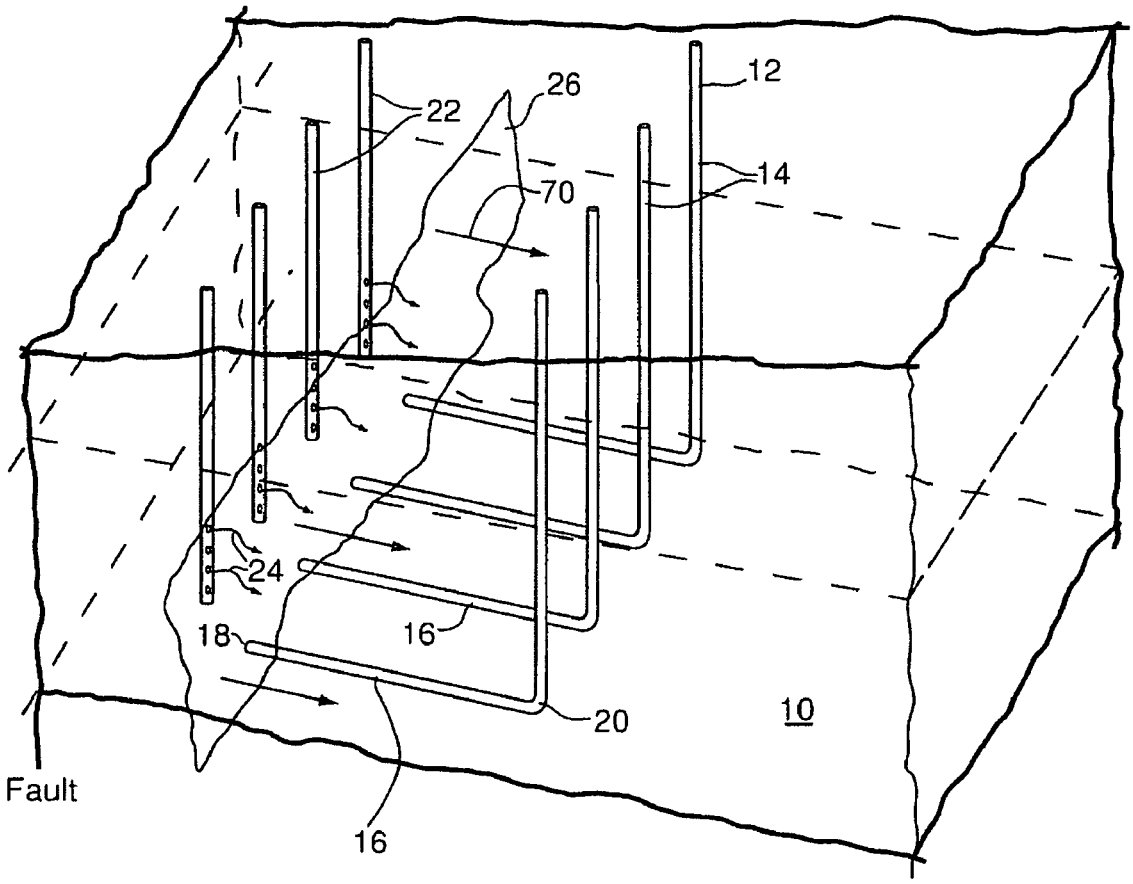
Fig.1A ( Prior Art )
FIG. 1A is a perspective schematic view of a prior-art in situ recovery arrangement in a hydrocarbon reservoir, showing air injection wells situated at the toe of each of corresponding horizontal legs of associated production wells.

FIG. 1A shows a schematic, semi-transparent view of an arrangement of wells utilized in the prior art for in situ recovery of hydrocarbon from a subsurface hydrocarbon reservoir or formation 10.

Specifically, FIG. 1A schematically depicts the prior art method of in situ recovery of hydrocarbon disclosed in U.S. Pat. No. 5,626,191, comprising locating a series of production wells 12, each comprising a substantially vertical section 16 and a substantially horizontal leg 16, having a "toe" portion 18 and a "heel" portion 20. The horizontal leg 16 of production well 12 is located at a lower region of hydrocarbon formation 10, and is substantially porous to allow ingress of fluids. A series of injection wells 22 are provided, situated at a region proximate the "toe" and extending downwardly into the formation 10, with perforations in the upper reaches of the oil-bearing reservoir.

Figure 1B:
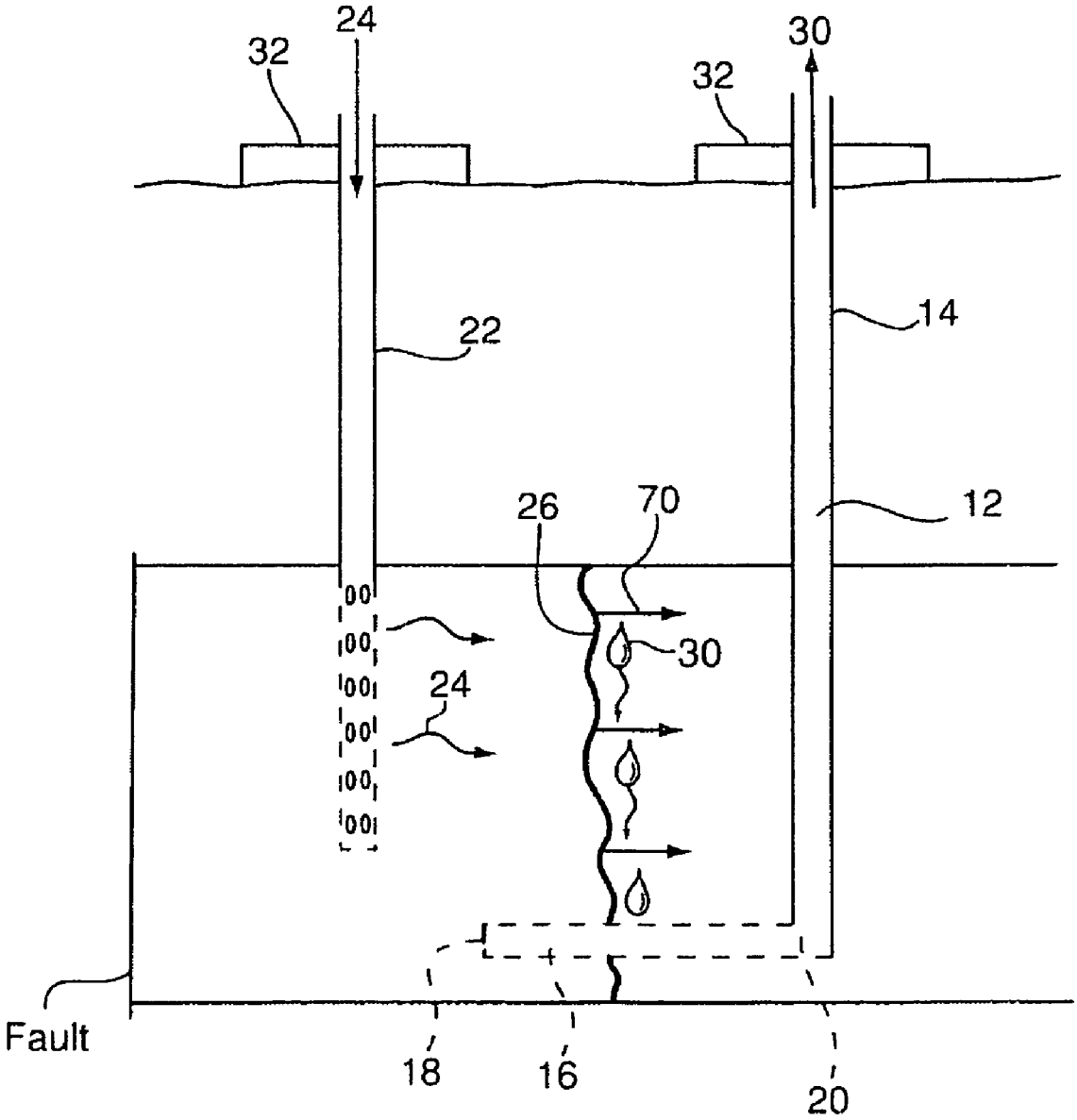
Fig.1B ( Prior Art )
FIG. 1B is a cross section through one injection well and associated production well shown in FIG. 1A.

FIG. 1B shows a schematic cross-section through an injection well 22 and associated production well 12 of FIG. 1A.

In the prior art in situ recovery process depicted in FIGS. 1A & B, an oxidizing gas 24, such as air (which contains oxygen), oxygen, or oxygen-enhanced air, is injected into the formation 10 via each of injection wells 22, so as to permit a portion of the hydrocarbon in formation 10 to be combusted. Specifically, a portion of the hydrocarbon in hydrocarbon formation 10 in the region of the injection well 22 when supplied with the oxidizing gas 26 is caused to be ignited and caused to combust, thereby forming and creating within formation 10 a substantially vertical and laterally-extending combustion front 26. Such combustion front 26, by way of heat conduction and creation of heated combusted gases within formation 10, heats hydrocarbons in the formation 10 directly ahead and in advance of combustion front 26, causing the more volatile hydrocarbon compounds in formation 10 to gasify and further cause upgrading of a portion of the hydrocarbon solids or bitumens in the formation simultaneously increasing their viscosity so as to create mobile liquefied hydrocarbons 30. The remaining heavier hydrocarbons, particularly coke, remain, which provide fuel for the advancing combustion front 26 and sustain the advance of the combustion front 26 and the in situ combustion and hydrocarbon upgrading process. Then mobile liquefied hydrocarbons 30 and gasified components (some of which may subsequently condense as liquids 30), then flow downwardly by action of gravity through the formation and are collected in a lowermost region of the formation 10 by flowing into horizontally-extending horizontal leg 16 of the production well 12. Horizontal leg 16 of production well 12 generally has, at least for a limited time, a gas pressure therein less than that of the formation 10 (due to removal of collected liquid hydrocarbons 30 as well as gaseous hydrocarbons therefrom), Such reduced gaseous pressure in horizontal leg 16 as opposed to within formation 10 in advance of combustion front 26 assists in liquid and gaseous hydrocarbon inflow from hydrocarbon formation 10 into the horizontal leg 16. At other times, due to injection of medium 52 via injection tubing 50 (discussed below) into horizontal leg 16, horizontal leg 16 may at times may have a gaseous pressure close to, or even in excess of the gas pressure within formation 10.

Importantly, in the prior art method of in situ recovery as shown in FIGS. 1A & B and described above, injection wells 22 are situated proximate the "toe" of the horizontal leg 16, and oxidizing gas injected into the formation at these locations via the injection wells 22. The combustion front 26 which receives oxidizing gas 24 is thus caused to progress outwardly from the injection well 22, and perpendicular to and along the horizontal wells 16 in a direction from the "toe" portion to the "heel" portion.

Disadvantageously with this prior art method, not only need a drilling pad 32 be created for the production well 12, but an additional and separate drilling pad need be created for the injection well 22, and such separate injection well 22 need be drilled into such formation. In addition, oxygen creation and injection equipment (not shown) must be hauled to and installed at the surface of such injection well 22, as such injection well is remote from the surface of production well 12. Both of such requirements add significantly to the cost of carrying out the prior art methods of in situ recovery of hydrocarbons.

Figure 2A:
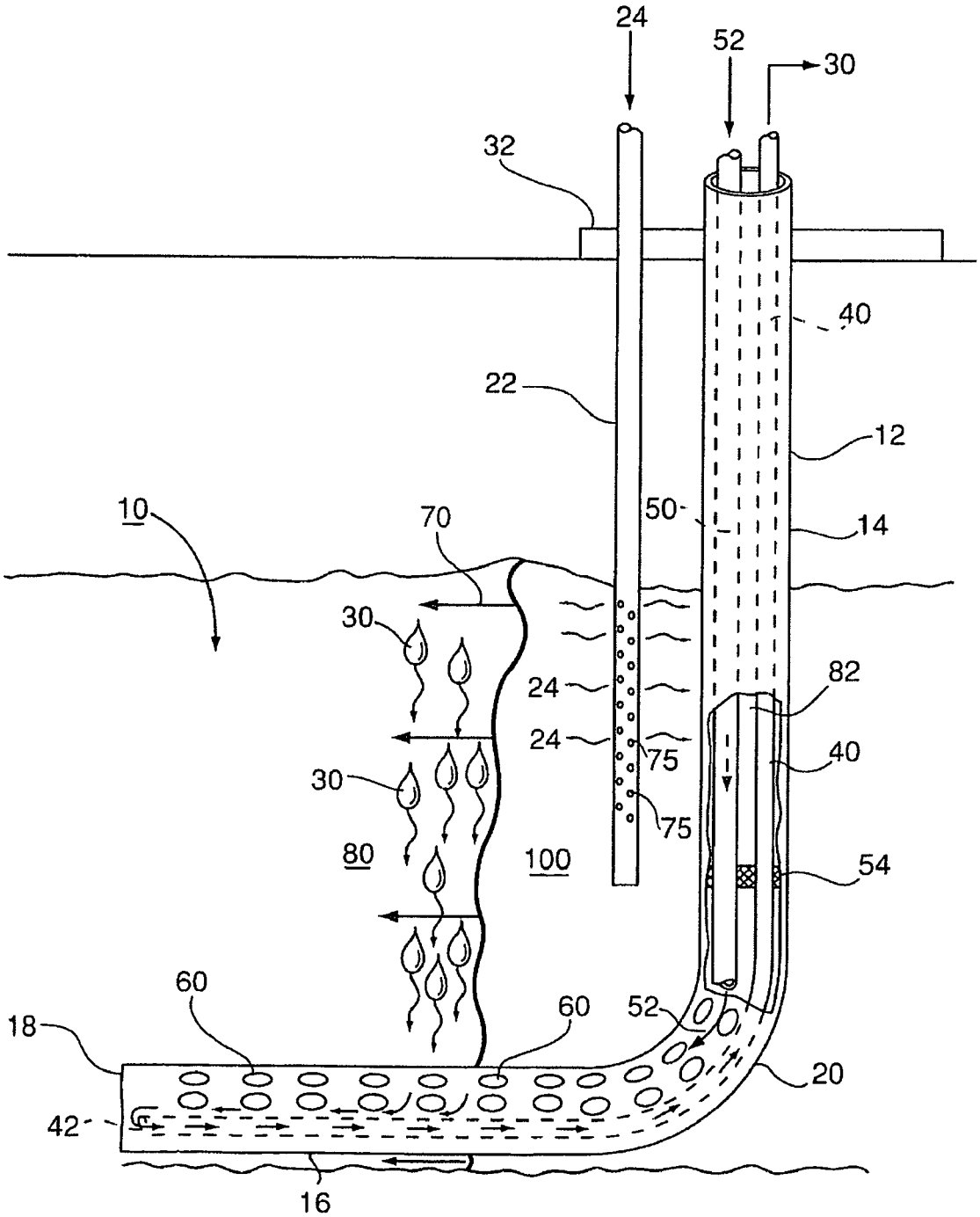
FIG. 2A is a schematic cross-section (not to scale) through one injection well and associated production well of a first embodiment of the present invention, using the method of the present invention of causing a combustion front to propagate in the direction of the "toe" of the horizontal leg of the production well, at a point in time close to the time of ignition of the hydrocarbon and the initial propagation of the combustion front.
Figure 2B:
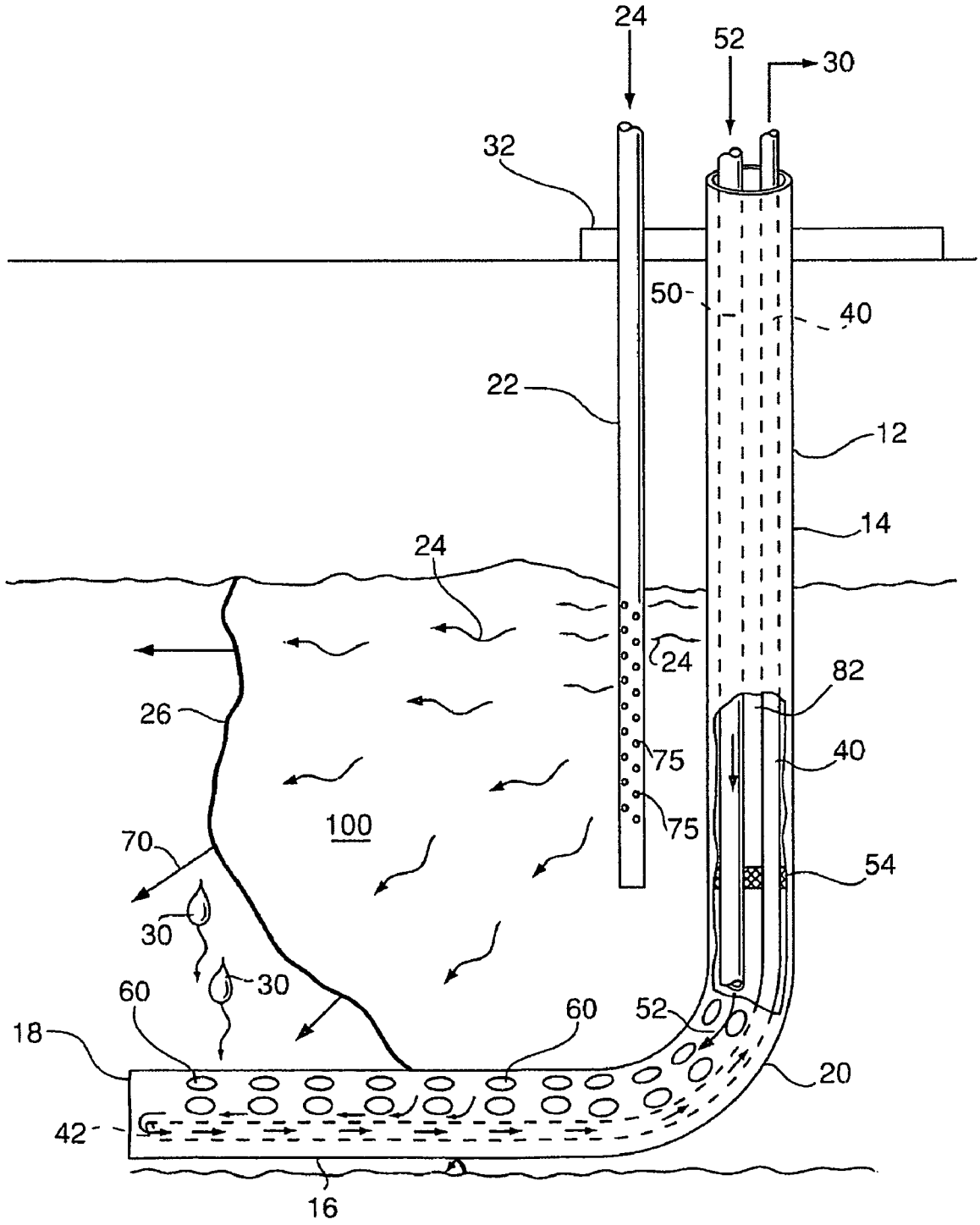
FIG. 2B is a similar cross-section to that of FIG. 2A, likewise not to scale, at a subsequent point in time when the combustion front has propagated for a time and moved closer to the "toe" portion of the horizontal leg of the production well.
Figure 2C:
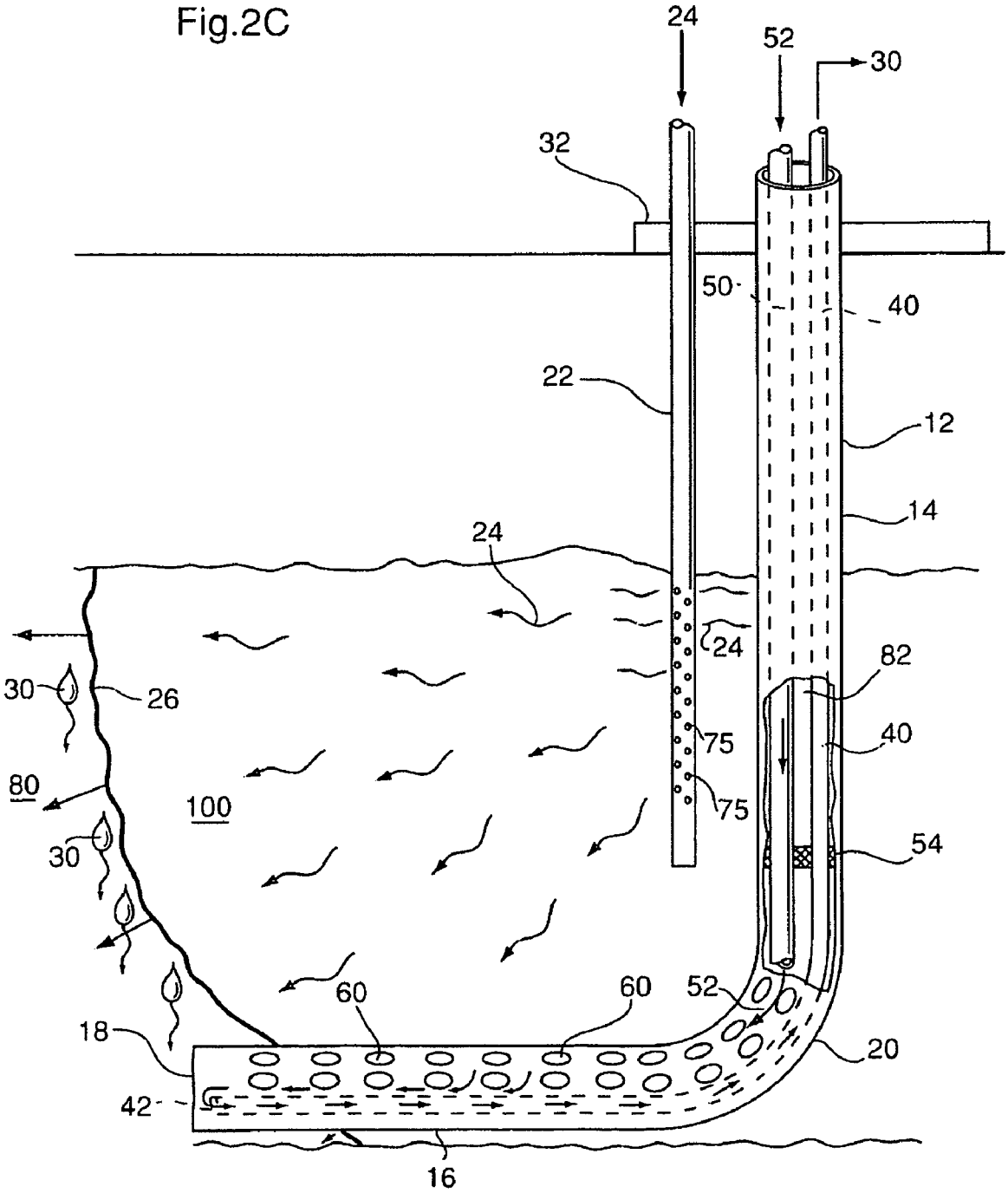
FIG. 2C is a similar cross-section to that of FIG. 2B, likewise not to scale, at a still further point in time when the combustion front has further propagated and moved even closer to the "toe" portion of the horizontal leg of the production well.

FIGS. 2A-2C herein show a modified (first) in situ recovery process, which is expressly adapted to eliminate at least one of the above expenses in the prior art methods of in situ hydrocarbon recovery, namely the expense of creating a separate drilling pad for the injection well 22.

Specifically, as seen in FIGS. 2A-2C, a single drilling pad 32 is created by way of clearing of trees and other obstacles, and a single drill platform erected thereon. A production well 12 is drilled using conventional drilling techniques, comprising a vertical section 14, and a further horizontal leg 22 in communication with vertical section 14. The horizontal leg 16 has a "toe" portion 18 and a "heel" portion 20 where it meets vertical section 14. The production well 12 is completed by the usual process of casing well 12, and further by the insertion within such production well 12 of production tubing 40, which extends downwardly in vertical section 14 to such heel portion 20 and preferably along the horizontal leg 16, preferably to toe portion 18 thereof, such production tubing 40 having an open end 42 within said horizontal leg 16. Production tubing 40 is typically coiled tubing as is conventionally used in drilling operations.

Additional injection tubing 50, likewise typically coiled tubing as is conventionally used in drilling operations, is further provided for injection of a medium 52 into production well 12, such medium 52 comprising a non-oxidizing gas, preferably carbon dioxide due to its diluent effect on hydrocarbons, or alternatively or in combination steam or water or other non-combustible flowable medium. As seen from FIGS. 2A-2C, injection tubing 50 extends into the "heel" portion 20 of horizontal leg 16. At least one isolation packer 54 is provided to allow medium 52 to be injected, if desired, in a pressurized state from time to time or continuously injected, so as to pressurize from time to time or continuously if desired, horizontal leg 16 to assist in forcing liquefied hydrocarbon 30 into production tubing 40 and inhibiting entry of oxidizing gas into the horizontal leg 16.

Using the single drilling pad 32, a further injection well 22 is drilled, extending into at least the upper region of the hydrocarbon formation 10. Injection well 22 typically has perforations 75 in a lower end thereof to permit infusion and injection of an oxidizing gas 24 such as air or oxygen into the hydrocarbon-containing region of hydrocarbon formation 10.

The method of the present invention, in the first embodiment shown in FIGS. 2A-2C, thereafter operates as follows:

Oxidizing gas 24 is injected into formation 10 via injection well 22. Advantageously, equipment (not shown) used to create oxidizing gas 24 and inject such oxidizing gas 24 need not be located remote from the production well 12, but instead can, by virtue of the method of the present invention, be located proximate to production well 12, and in particular if desired may be located on drilling pad 32 or closely proximate thereto, thereby eliminating the need for clearing and creating a separate drilling pad at a remote site such as would occur if the injection well 22 were located towards the "toe" of horizontal well 16. Also, operation and maintenance of the oxidizing gas supply equipment can conveniently be conducted at the oil-treating site located near well 12. Hydrocarbons proximate the injection well 22 are ignited, and due to the supply of oxidizing gas 24, a combustion front 26 is created, which in the method shown in FIGS. 2A-2C, advances as a substantially vertical laterally extending front (see also FIG. 5 herein) from the "heel" 20 of horizontal leg 16 towards the "toe" 18. Viscous and high viscosity hydrocarbons, including bitumen, in the hydrocarbon formation 10 in advance of the advancing combustion front 26, due to heat which is generated, are caused to upgrade and become liquid, and in the process become less viscous. Some hydrocarbons in the formation 10 in advance of the front 26 will gasify. Liquified hydrocarbons 30 and gasified hydrocarbons, now being mobile, flow downwardly and into horizontal leg 16 which is made porous (ie has apertures 60 in an upper portion thereof) to permit infusion of such hydrocarbons 30 and thus collection of such hydrocarbons 30.

Such process continues as combustion front 26 progresses and thus "sweeps" from the "heel" portion 20 to the "toe" 18 of horizontal leg 16.

Notably, prior to generation of combustion front 26, hydrocarbon formation 10 is preferably initially preheated by injection of a heated non-oxidizing medium 52 such as steam, which is injected into the horizontal leg 16 of production well 12 via injection tubing 40, and removed via production tubing 50 or alternatively via annulus 80 in vertical section 16 if isolation packers 54 are not present. Pre-injection of a heated medium has the benefit of heating the production well 12 and its production components thereby increasing the flowability of liquefied hydrocarbons 30 which flow into horizontal leg 16 of production well 12. This procedure is useful in bitumen reservoirs because cold oil that may enter the horizontal leg 16 will be very viscous and will flow poorly, possible plugging the horizontal leg 16. For formations 10 with mobile oil, extensive pre-ignition steaming is not required for the purpose of heating the oil so that it will flow, however, it can be useful to reduce oil saturations near the oxidizing gas injection well 22 and to raise the hydrocarbon temperature to achieve ignition thereof. Other ignition methods may be employed such as the injection of easily ignitable fuels such as linseed oil, or by injection of hot combustion gas. For bitumen reservoirs, steam is also injected via injector well 22 and may also be injected into the reservoir 10 in the region between the injector well 22 and the toe 18 of the horizontal well 16 to warm the oil and increase its mobility prior to initiating injection of oxidizing gas 24 into the reservoir formation 10.

After initiation of combustion and combustion front 26, a non-oxidizing medium 52 in the form of steam, a non-oxidizing gas such as carbon dioxide, or water, is injected, either continuously or sporadically via injection tubing 50 into horizontal leg 16, which due to isolation packers 54, can be pressurized. The purpose of such non-oxidizing medium 52 is for a number of reasons. Firstly, increased pressure within horizontal leg 16 reduces or prevents oxidizing gas 24 infusing into horizontal leg 16 from formation 10 which could otherwise detrimentally, in combination with liquefied and gaseous hydrocarbons therein, form an explosive mixture with potentially explosive consequences, or alternatively react with oxygen directly so as to form coke which could otherwise seal the horizontal leg 16 of production well 12. The consequence of having hydrocarbon (oil) and oxygen together in a wellbore is combustion and potentially an explosion with the attainment of high temperatures, perhaps in excess of 1000° C. This can cause irreparable damage to the wellbore, including the failure of the sand retention screens (not shown). The presence of oxygen and wellbore temperatures over 425° C. must be avoided for safe and continuous oil production operations. Secondly, injection of medium 52 can serve to pressurize horizontal leg 16 and assist in driving liquefied and gaseous hydrocarbons 30 collected in horizontal leg 16 into the open end 42 of production tubing 40, thereby assisting in drawdown of such liquids 30 and producing such hydrocarbons 30 from producing well 12. Thirdly, medium 52 when injected via injection tubing 50 can be heated. Advantageously, means for heating such medium 52 are, in this method, conveniently capable of being located at the surface of production well 12 and on or near drilling pad 32. Lastly, where the injected medium 52 is carbon dioxide, injection thereof into horizontal well 16 serves as not only a convenient carbon "sink" to allow disposal of such greenhouse gas, but further due to the diluent properties on carbon dioxide on liquid hydrocarbons 30, reduces the viscosity thereof and thus aids in the drawdown of collected liquid hydrocarbons 30 via production tubing 40.

As seen from FIGS. 2A-2C, during the advance of combustion front 26, coke is deposited in the reservoir 10 and serves as fuel for the in situ combustion process. Hot combustion gases 70 advance into formation 10 heating the hydrocarbon therein and any connate water that is present. A portion of these hydrocarbons liquefies and such liquefied hydrocarbons 30 flow, along with combustion gases, into the horizontal leg 16 through the perforations 60, as shown in FIGS. 2A-2C. The liquefied hydrocarbons 30 flow along and to the "toe" 18 of horizontal leg 16 and enter the open end 42 of production tubing 40 therein, and flow back and then upward to the surface. The process is stable and continuous, with the combustion front 26 continuously advancing towards the "toe" 18 of the horizontal leg 16.

The oxidizing gas 24, typically air, oxygen or oxygen-enriched air, is injected into the upper part of the reservoir 10. Coke that was previously laid down consumes the oxygen so that only oxygen-free gases contact the oil ahead of the coke zone at the combustion front 26. Combustion gas temperatures of typically 600° C. and as high as 1000° C. are achieved from the high-temperature oxidation of the coke fuel. In the mobile oil zone 80 in advance of the combustion front 26, these hot gases 70 and steam heat the oil to over 400° C., partially cracking the oil, vaporizing some components and greatly reducing the oil viscosity. The heaviest components of the oil, such as asphaltenes, remain on the rock and will constitute the coke fuel later when the combustion front 26 arrives at that location. In the mobile oil zone 80, gases and oil drain downward into the horizontal leg 16, drawn by gravity and at times by the low-pressure sink of the horizontal leg 16 when unpressurized. The coke zone at the combustion front 26 and the mobile oil zone 80 move laterally from the direction from the heel 20 towards the toe 18 of the horizontal well 16. The burned zone section 100 behind the combustion front is depleted of liquids (oil and water) and is filled with oxidizing gas 24. The section of the horizontal well 16 opposite this burned zone 100 is in jeopardy of receiving oxygen or oxidizing gas 24 which will combust the oil present inside horizontal well 16 creating extremely high wellbore temperatures that would damage the steel casing and especially the sand screens that are used to permit the entry of fluids 30 but exclude sand. If the sand screens fail, unconsolidated reservoir sand will enter the horizontal wellbore 16 and necessitate shutting for cleaning-out and remediation with cement plugs.

This operation is very difficult and dangerous since the horizontal wellbore 16 can contain explosive levels of oil and oxygen.

The method of the present invention contemplates a number of ways to prevent influx of oxidizing gas 24 from the formation 10 into the horizontal leg 16. A first method is to reduce the injection rate of the oxidizing gas 24 in order to reduce the reservoir pressure in formation 10. A second method is to reduce the liquefied hydrocarbon 30 drawdown rate via the production tubing 40 (ie reduce the production rate via production tubing 40) to thereby increase wellbore pressure in horizontal leg 16. Both of these methods result in the reduction of hydrocarbon production rates, which is economically detrimental. An alternative and preferred method is that as described previously herein, namely the injection of non-oxidizing medium 52 into horizontal leg 16 via injection tubing 50, which is believed to have little effect on gravity draining of hydrocarbon liquids into horizontal well 16. In any event, such injection of medium 52 may be done periodically and only for a time sufficient to reduce concentrations of oxygen within horizontal leg 16 to less-than-explosive concentrations. In a typical operation, a thermocouple string can be placed along the horizontal section, or within, and the occurance of elevated temperatures will signal the intrusion of oxidizing gas so that water of steam may be added via tubing 52 to reduce well-bore temperatures, dilute the oxygen present and increase wellbore pressure to inhibit further oxidizing gas entry.

Figure 3:
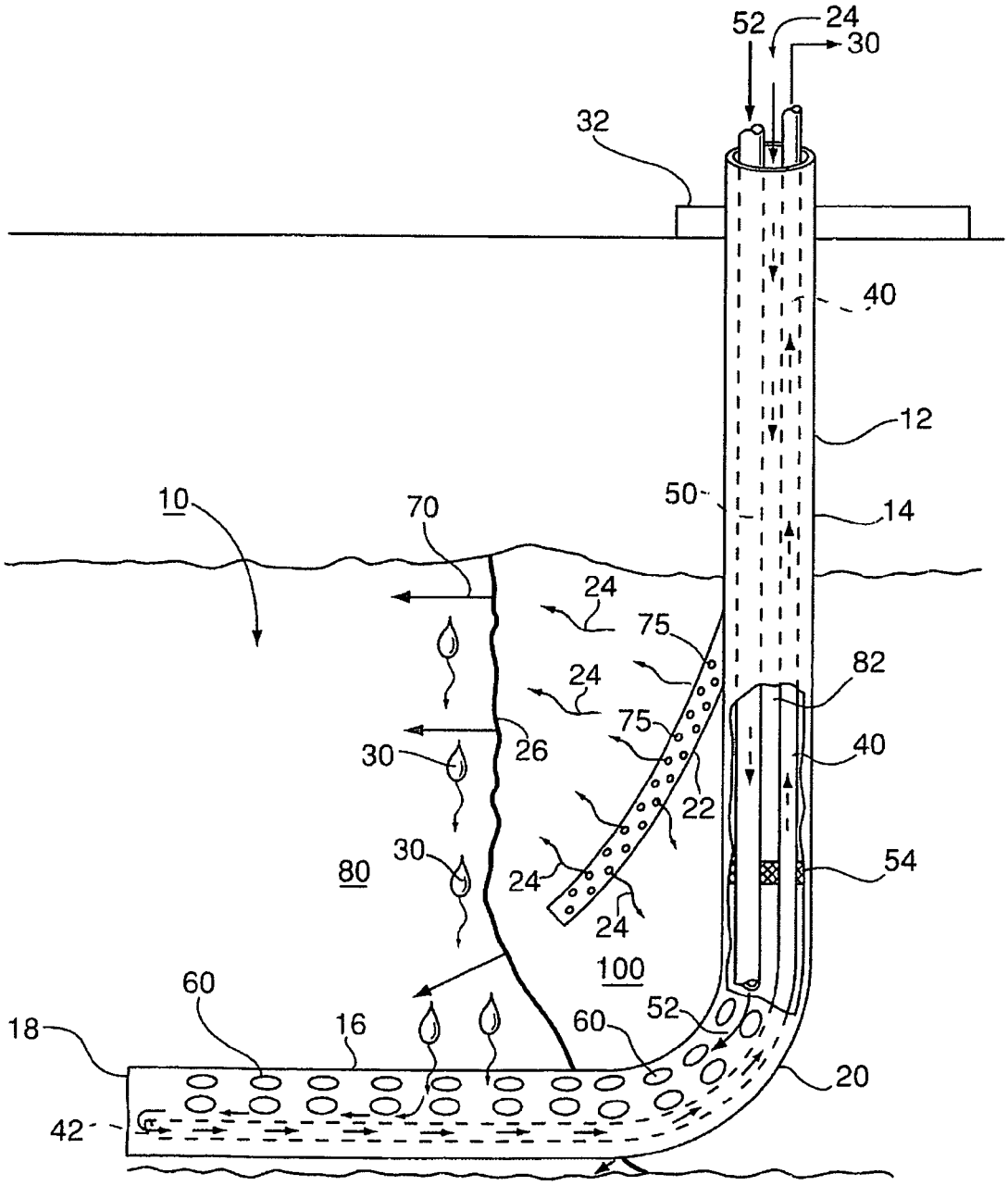
FIG. 3 is a schematic partial cross-section through a hydrocarbon reservoir containing a hydrocarbon-containing formation, which shows a second embodiment of the method of the present invention, namely a production well and associated side entry injection well (not to scale) and further depicting the method of the present invention of causing a combustion front to propagate in the direction of the "toe" of the horizontal leg of the production well, at a point in time close to the time of ignition of the hydrocarbon and the initial propagation of the combustion front.

FIG. 3 schematically illustrates a further more preferable embodiment of the method of the present invention, having similar components to those identified in FIGS. 2A-2C, and having similar methodology. Again, an oxidizing gas in injected into formation 10 via injection well 22, and a combustion front 26 created which "sweeps" from heel 20 to toe 18 of horizontal leg 16, causing liquefied hydrocarbons 30 as well as gasified hydrocarbons to flow into horizontal leg 16 and be delivered to surface via production tubing 40.

Notably, however, the important and sole distinction in the method of in situ recovery shown in FIG. 3 over the method previously discussed and as shown in FIGS. 2A-2C is that injection well 22 in the method depicted in FIG. 3 is formed as a side entry well from within vertical section 16 of production well 12.

Advantageously, using the method depicted in FIG. 3, injection well 22 is less expensive to drill as an upper portion of such injection well has already been drilled as it is common with vertical section 16 of production well 12.

Accordingly, not only are cost savings realized in locating the injection well 22 at the location of and in close proximity to the production well 12 and its associated equipment and no separate drill pad 32 needed to be created, but in addition, well drilling costs are reduced when drilling injection well 22.

Figure 4:
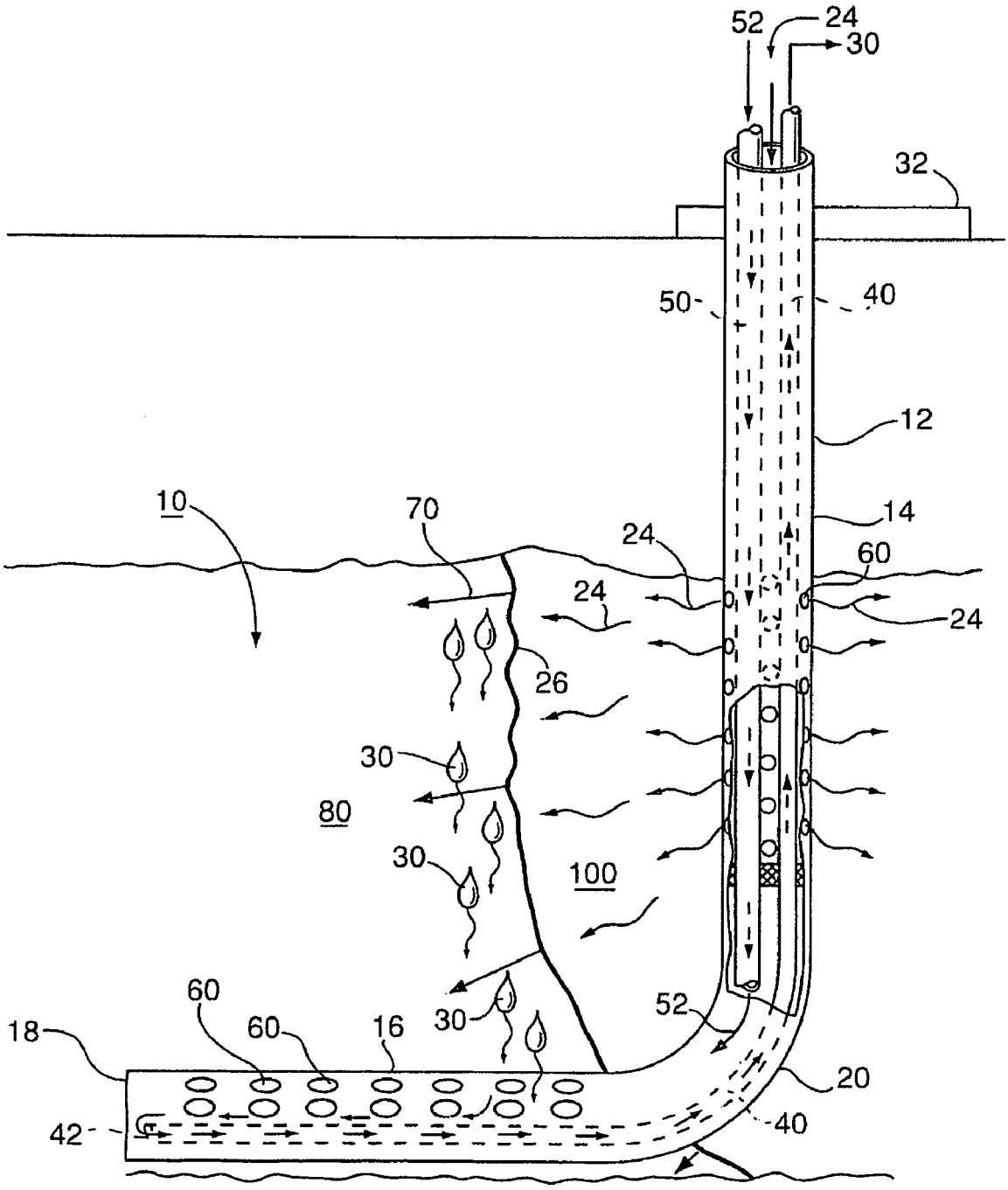
FIG. 4 is a schematic partial cross-section through a hydrocarbon reservoir containing a hydrocarbon-containing formation, which shows a third preferred embodiment of the present invention, namely a cross-section through a production well (not to scale) employing the method of the present invention of causing a combustion front to propagate in the direction of the "toe" of the horizontal leg of the production well, at a point in time close to the ignition of the hydrocarbon and the initial propagation of the combustion front.

FIG. 4 depicts a third and most preferred embodiment of the method of the present invention for carrying out in situ recovery of hydrocarbon. Such method, like the first embodiment of the method of the present invention depicted in FIGS. 2A-2C, and like the second embodiment of the invention depicted in FIG. 3, includes as an integral component of the method the creation of a combustion front 26 which "sweeps" from "heel" 20 to "toe" 18 of horizontal leg 16, thereby causing liquid hydrocarbons 30 to be collected in horizontal leg 16, and thereafter drawndown by production tubing 40 and produced to surface.

Importantly, however, in this third embodiment of the method of the present invention shown in FIG. 4, there is no step of drilling an injection well 22. Instead, perforations 110 are made in the vertical section 16 of production well 12, and an oxidizing gas 24 injected into such vertical section 16 and thus into formation 10. Oxidizing gas 24 is prevented from injection into horizontal leg 16 by the presence of isolation packers 54 which effectively separate produced liquefied hydrocarbons in horizontal leg 16 from oxidizing gas 24 such as oxygen, thereby preventing formation of explosive mixtures. Injection tubing 50 still serves, like in earlier embodiments, to permit sporadic or continuous injection of non-oxidizing gas 52 into horizontal leg 16 to prevent oxidizing gas 24 within the burned zone 80 of the formation from permeating into horizontal leg 16.

Advantageously, using the method depicted in FIG. 4, the cost of drilling an injection well 22 is completely eliminated. Accordingly, with the method depicted in FIG. 4, not only are cost savings realized and environmental impact reduced in being able to have oxidizing injection apparatus at the production well and only on a single drill pad 32 at the production well which is otherwise the case in prior art methods which require creation of a separate drill pad and additional clearing for oxidizing gas creation and injection equipment (not shown), but in addition substantial cost savings are achieved by elimination the necessity to drill any injection well.

Figure 5:
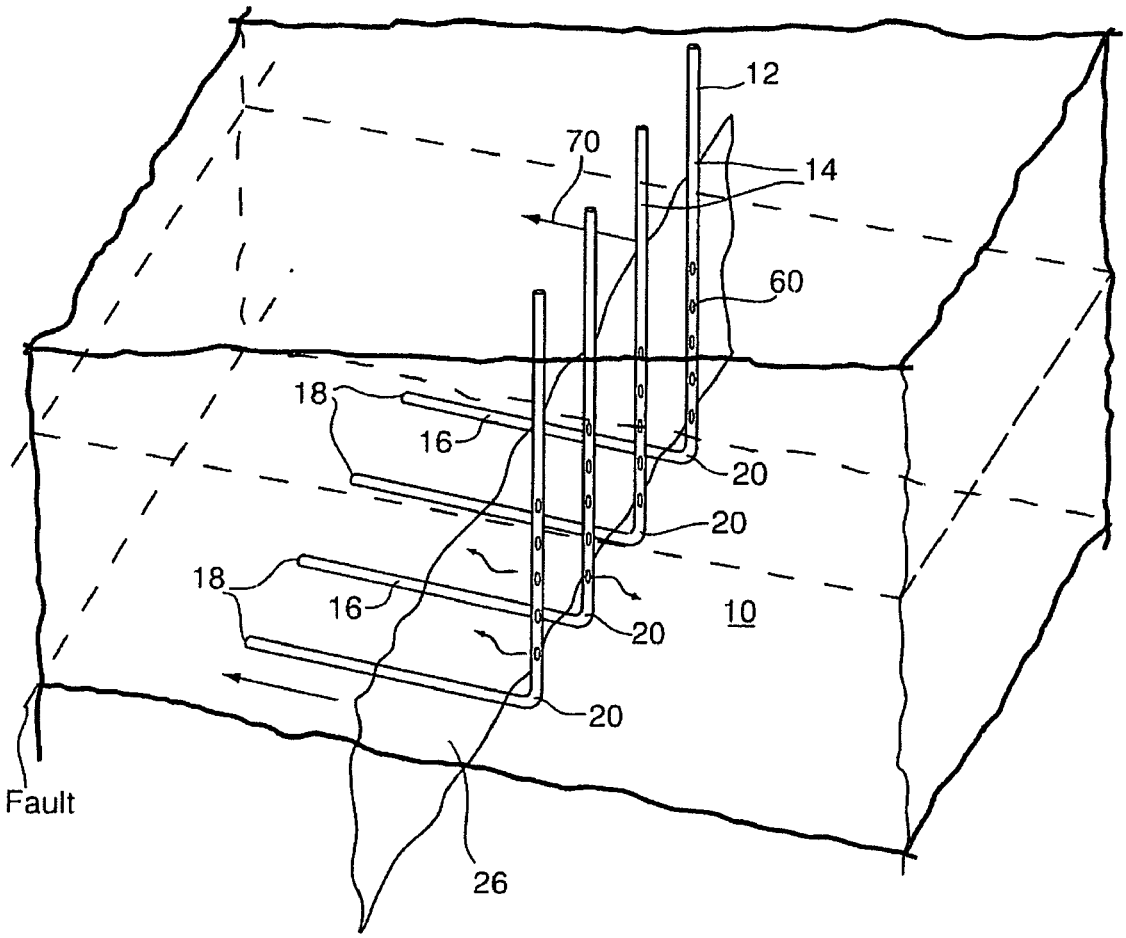
FIG. 5 is a perspective schematic view of an in situ recovery method of FIG. 4, showing the third and preferred embodiment of the method of the present invention for recovering hydrocarbons from a hydrocarbon reservoir

FIG. 5 depicts how the method of FIG. 4 (ie the third embodiment of the method of the present invention) may be deployed with a series of production wells 12 in a hydrocarbon formation 10, using a combustion front 26 which advances from "heel" 20 to "toe" 18.

Although the disclosure describes and illustrates preferred embodiments of the method of the present invention, it is understood that the invention is not limited to these particular embodiments. Many variations and modifications will now occur to those skilled in the art. For a full definition of the invention, reference is to be made to the appended claims.

We claim:

1. An in-situ combustion process for recovering liquefied or gasified hydrocarbon from an underground hydrocarbon reservoir without withdrawing combustion product from a region proximate a ceiling of the reservoir via a separate bleed well, comprising the steps of:

(a) providing at least one production well having a substantially horizontal leg positioned relatively low in said reservoir, said horizontal leg having at one end thereof a heel portion and at an opposite end thereof a toe portion, said horizontal leg adapted to permit inflow of liquefied hydrocarbon into an interior of said horizontal leg, said production well having a substantially vertical section connected to said horizontal leg proximate said heel portion thereof;

(b) providing production tubing inside said production well extending within said vertical section and within at least a portion of said horizontal portion to collect said liquefied hydrocarbon which flows into said horizontal leg;

(c) injecting a medium into the production well, wherein said medium is selected from the group of mediums consisting of a non-oxidizing gas, steam, water, carbon dioxide, or mixtures thereof;

(d) supplying an oxidizing gas to said underground reservoir, at least initially at a location of, or proximate, said vertical section of said production well;

(e) igniting hydrocarbon within said hydrocarbon reservoir proximate said vertical section of said production well, so as to cause combustion of a portion of said hydrocarbon in said hydrocarbon reservoir proximate said vertical section and thereby create a combustion front which advances outwardly and away from said vertical section of said production well in at least a direction along said horizontal leg and towards said toe portion thereof;

(f) causing heated liquefied hydrocarbon from said reservoir to drain from upper regions thereof and collect in said horizontal leg; and (g) removing from the production well, via said production tubing, said hydrocarbon which has flowed into said horizontal leg.

2. The process of claim 1 wherein said step of supplying said oxidizing gas is accomplished by supplying said oxidizing gas to said hydrocarbon formation via in an injection well, at a location in said formation above said horizontal leg.

3. The process of claim 2, wherein said vertical section of said production well and said injection well are one and the same.

4. The process of claim 1 wherein the injection well is a side track re-entry of the vertical section of the producer well, and extends into an upper region of the reservoir.

5. The process of claim 1 wherein the supply of oxidizing gas is accomplished by drilling an injection well proximate said vertical section of said production well, and said injection well is vertical, slanted, or horizontal.

6. The process of claim 1 wherein said vertical section of said production well is perforated in an upper part thereof, and said step of supplying an oxidizing gas is achieved at least in part by supplying said oxidizing gas via said vertical section of said production well.

7. The process of claim 1 further comprising the steps of:

providing injection tubing in said production well, said injection tubing extending downwardly in said vertical section to at least said heel portion of said horizontal leg, and said step of injecting said medium into said production well being conducted by injecting said medium via said injection tubing.

8. The process of claim 7 wherein an open end of the production tubing is situated in the vicinity of the toe portion of the horizontal leg.

9. The process of claim 1 wherein said toe portion is situated in the formation slightly lower in elevation than said heel portion.

10. The process of claim 1, 7, or 8 wherein said medium is injected continuously or periodically into said production well so as to maintain a positive pressure within the horizontal leg and thereby assist in preventing ingress of said oxidizing gas from the reservoir into the horizontal leg of the production well.

11. The process of any one of claims 1-8 wherein catalyst is placed in, on or around the horizontal leg of the production well.

12. The process of any one of claims 1-8 wherein the oxidizing gas is a mixture of oxygen and carbon dioxide.

* * * * *

UNITED STATES PATENT AND TRADEMARK OFFICE

CERTIFICATE OF CORRECTION

PATENT NO. : 7,841,404 B2
APPLICATION NO. : 12/068881
DATED : November 30, 2010
INVENTOR(S) : Conrad Ayasse, Xinjie Wu and Chris Bloomer It is certified that error appears in the above-identified patent and that said Letters Patent is hereby corrected as shown below:

In the Claims

Column 13, line 11, In Claim 2: take out the word "in" which presently appears in the second line, between the words "via" and "an". Claim 2 should then appear as it is below:

2. The process of claim 1 wherein said step of supplying said oxidizing gas is accomplished by supplying said oxidizing gas to said hydrocarbon formation via an injection well, at a location in said formation above said horizontal leg.

Column 13, line 16, In Claim 4, the claim referenced should be claim 2 not claim 1. Claim 4 should then appear as it is below:

4. The process of claim 2 wherein the injection well is a side track re-entry of the vertical section of the producer well, and extends into an upper region of the reservoir.

Signed and Sealed this
Eleventh Day of March, 2014

Michelle K. Lee

Michelle K. Lee
*Deputy Director of the United States Patent and Trademark Office*